United States Patent [19]

Carcia, III

[11] Patent Number: 4,971,592

[45] Date of Patent: Nov. 20, 1990

[54] TOY GHOST DETECTOR DEVICE

[76] Inventor: Joseph P. Carcia, III, 59 Holl St., Manchester, Conn. 06040

[21] Appl. No.: 459,207

[22] Filed: Dec. 29, 1989

[51] Int. Cl.[5] ..... A63H 33/22; A63H 33/30; A63H 29/22

[52] U.S. Cl. ..... 446/219; 446/76; 446/473; 446/484; 272/8 P

[58] Field of Search ..... 446/219, 175, 85, 91, 446/71, 72, 73, 74, 76, 429, 484, 485, 473, 23, 26; 350/4.1, 4.2; 272/8 P

[56] References Cited

U.S. PATENT DOCUMENTS

| | | | |
|---|---|---|---|
| 1,662,743 | 3/1928 | Hanson | 350/4.2 |
| 2,574,952 | 11/1951 | Bergen | 446/23 X |
| 2,734,310 | 2/1956 | Christopher | 446/473 X |
| 3,294,397 | 12/1966 | Du Rand III | 446/485 X |
| 3,352,557 | 11/1967 | Maher | 446/23 |
| 3,508,751 | 4/1970 | Meyer et al. | 273/310 X |
| 3,696,548 | 10/1972 | Teller | 446/91 |
| 4,291,878 | 9/1981 | Nagel et al. | 446/429 X |
| 4,361,981 | 12/1982 | Reiling et al. | 446/219 |
| 4,508,511 | 4/1985 | McQueen | 446/485 X |
| 4,588,387 | 5/1986 | Swenson | 446/485 X |
| 4,756,703 | 7/1988 | Kennedy et al. | 446/26 |
| 4,768,681 | 9/1988 | Dean et al. | 446/475 X |
| 4,789,371 | 12/1988 | Boggs et al. | 446/219 |
| 4,802,675 | 2/1989 | Wong et al. | 446/473 X |

FOREIGN PATENT DOCUMENTS

| | | | |
|---|---|---|---|
| 456831 | 5/1949 | Canada | 350/4.2 |
| 1127849 | 7/1982 | Canada | 446/485 |
| 2549200 | 1/1985 | France | 446/175 |

*Primary Examiner*—Robert A. Hafer
*Assistant Examiner*—D. Neal Muir
*Attorney, Agent, or Firm*—Leon Gilden

[57] ABSTRACT

An apparatus is set forth to provide a toy to enhance the imagination and entertainment of children simulating ghost detection and capture. The device includes a central cabinet provided with a battery powered sequencing of LED lights. The lights are mounted upon spaced "L" shaped arms directed in a parallel relationship relative to the main cabinet. A further series of lights mounted on a forward face of the cabinet cooperates with the LED lights to enhance the visual effect of their use. Accessories include a forwardly mounted ghost capturing concial illumination barrel mounted to a forward panel of the cabinet, and further including a telescopic lens utilizing multi-colored panels to enhance visual effect of the device.

7 Claims, 4 Drawing Sheets

TOY GHOST DETECTOR DEVICE

BACKGROUND OF THE INVENTION

1. Field of the Invention

The field of invention relates to toy devices, and more particularly pertains to a new and improved toy ghost detector device utilizing various visual effects in coordination with accessories to enhance the imaginative and fanciful use of the device by a child.

2. Description of the Prior Art

The use of fanciful toys for the enhancement and enrichment of a child's imagination and idle time have been set forth in the prior art to funnel the child's growth in a constructive manner in the employment of fanciful toys. Examples of such toys may be found in U.S. Pat. No. 3,352,557 to Maher wherein a space vehicle simulating game utilizes various colored lights in association with projectiles in the playing of the game.

U.S. Pat. No. 2,574,952 to Berger sets forth a toy machine gun utilizing audible sounds simulating automatic weapons fire.

U.S. Pat. No. 4,756,703 to Kennedy provides a wrist borne launcher in association with a toy vehicle to enable a child and the like to launch an airborne vehicle from a wrist mounted station.

U.S. Pat. No. 4,768,681 to Dean sets forth a glove for use by a child with a water reservoir in association with a pump and electrical motor to direct squirts of water forwardly of the toy and the glove in use.

U.S. Pat. No. 4,802,675 to Wong sets forth a toy gun where an electronic target registers contact by an associated gun utilizing an electronic flash tube associated to a circuit to produce high voltage from a supply source.

As such, it may be appreciated that there is a continuing need for a new and improved toy ghost detector device which addresses both the problems of ease of use by a child, as well as the productive and effective enrichment of a child's imagination, and in this respect the present invention substantially fulfills this need.

SUMMARY OF THE INVENTION

In view of the foregoing disadvantages inherent in the known types of toy devices now present in the prior art, the present invention provides a toy ghost detector device wherein a device utilizes various visual and audible associations to enhance a child's imagination in the playing of a ghost capturing game. As such, the general purpose of the present invention, which will be described subsequently in greater detail, is to provide a new and improved toy ghost detector device which has all the advantages of the prior art toy devices and none of the disadvantages.

To attain this, the present invention includes an apparatus providing a toy to enhance the imagination and entertainment of children simulating ghost detection and capture. The device includes a central cabinet provided with a battery powered sequencing of LED lights. The lights are mounted upon spaced "L" shaped arms directed in a parallel relationship relative to the main cabinet. A further series of lights mounted on a forward face of the cabinet cooperates with the LED lights to enhance the visual effect of their use. Accessories include a forwardly mounted ghost capturing conical illumination barrel mounted to a rear panel of t he cabinet, and further including a telescopic lens utilizing multi-colored panels to enhance visual effect of the device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, no is it intended to be limiting as to the scope of the invention in any way.

It is therefore an object of the present invention to provide a new and improved toy ghost detector device which has all the advantages of the prior art toy devices and none of the disadvantages.

It is another object of the present invention to provide a new and improved top ghost detector device which may be easily and efficiently manufactured and marketed.

It is a further object of the present invention to provide a new and improved toy ghost detector device which is of a durable and reliable construction.

An even further object of the present invention is to provide a new and improved toy ghost detector device which is susceptible of a low cost of manufacture with regard to both materials and labor, and which accordingly is then susceptible of low prices of sale to the consuming public, thereby making such toy ghost detector devices economically available to the buying public.

Still yet another object of the present invention is to provide a new and improved toy ghost detector device which provides in the apparatuses and methods of the prior art some of the advantages thereof, while simultaneously overcoming some of the disadvantages normally associated therewith.

Still another object of the present invention is to provide a new and improved toy ghost detector device wherein the same utilizes coordinated visual and mechanical effects to simulate the detection and capturing of ghosts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
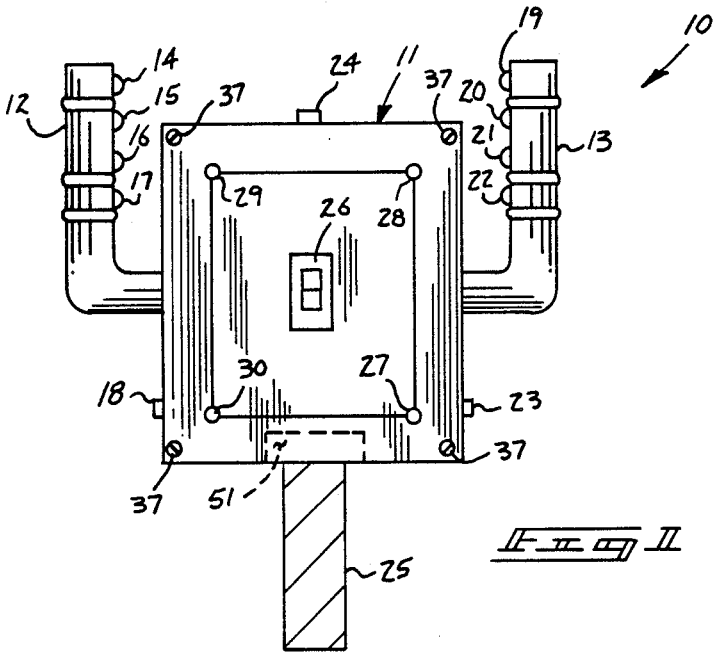
FIG. 1 is an orthographic front view taken in elevation of the instant invention.
Figure 2:
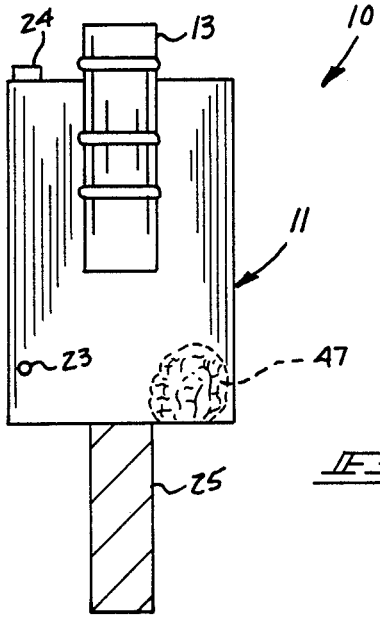
FIG. 2 is an orthographic side view taken in elevation of the instant invention.

With reference now to the drawings, and in particular to FIGS. 1 to 8 thereof, a new and improved toy ghost detector device embodying the principles and concepts of the present invention and generally designated by the reference numerals 10, 10*a*, and 10*b* will be described.

More specifically, the toy ghost detector device 10 of the instant invention essentially comprises a cabinet 11 of a generally rectangular parallelepiped configuration. A handle support rod 25 is directed orthogonally and downwardly from a bottom surface of the cabinet 11, wherein the cabinet 11 further includes a first "L" shaped arm 12 and a second "L" shaped arm 13 directed exteriorly of each respective side of the cabinet 11 and arranged for the longer arm of the "L" shaped configuration to be arranged parallel to the sides of the cabinet 11. A series of LED lights (light emitting diode) are arranged upon interior surfaces in a confronting relationship with the cabinet side walls on interior surface of each of the respective first and second arms 12 and 18 to provide a numerical sequencing of lights comprising a first LED light 14, a second LED light 15, a third LED light 16, and fourth LED light 17, a fifth LED light 18, a sixth LED light 19, a seventh LED light 20, and eighth LED light 21, a ninth LED light 22, and a tenth LED light 23. The LED lights are provided, as noted above, upon interior surfaces of the arms 12 and 13, as well as a further light upon each side of the cabinet 11 underlying each respective arm. The LED lights are operative to flash in a sequence utilizing conventional sequencing circuitry available to one of ordinary skill in the art. Upon the forward face of the cabinet 11 is a further series of lights comprising a first cabinet LED light 27, a second cabinet LED light 28, a third cabinet LED light 29, and a fourth cabinet LED light 30 arranged in a rectangular configuration about the forward surface of the cabinet. Positioned medially of the four flashing LED lights 27 through 30 is an LED numerical display counter 26 cooperative with the sequencing of the lights 14 through 23 to illustrate a display of 0 through 9 in cooperation with the light displays 14 through 23. The cabinet LED lights 27 through 30 are operative to flash simultaneously with the LED lights 21, 17, 15, and 14 in association with the cabinet LED lights 27, 28, 29, and 30 respectively. The framing effect of the cabinet lights 27 through 30 is further utilized to enhance visual effect of the organization. An on/off switch 24 is mounted onto the top wall of the cabinet 11 to effect selective actuation of the various LED lights and circuitry associated therewith.

A sequencing means 51 may be readily mounted interiorly of the cabinet 11, as illustrated in FIG. 1, in association with the light members.

Figure 3:
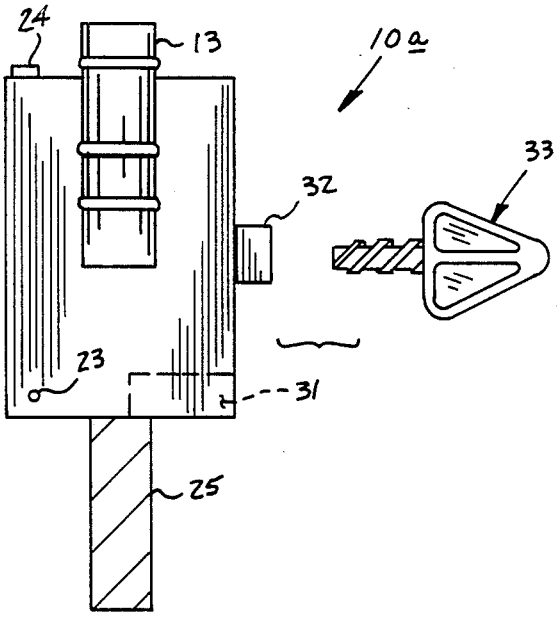
FIG. 3 is an orthographic side view of a modification of the instant invention.
Figure 4:
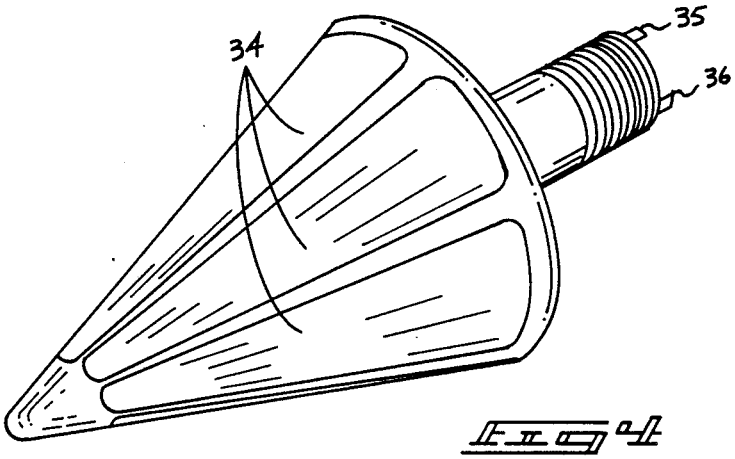
FIG. 4 is an isometric illustration of an illumination device utilized by the instant invention.

Reference to FIG. 3 illustrates a modified device 10*a* utilizing a rear socket 32 arranged to threaded receive a conical illumination barrel 33. The barrel 33 is formed with a threaded stem receivable within the socket 32, as well as multi-colored translucent colored panels 34 about the conical barrel's side surface. The barrel is provided with a first and second respective contact 35 and 36 cooperative with the socket to illuminate the socket in association with a battery supply compartment 31 mounted interiorly of the cabinet 11 and accessible by removal of the securement screws 37 mounted through the forward face of the cabinet structure 11.

Figure 5:
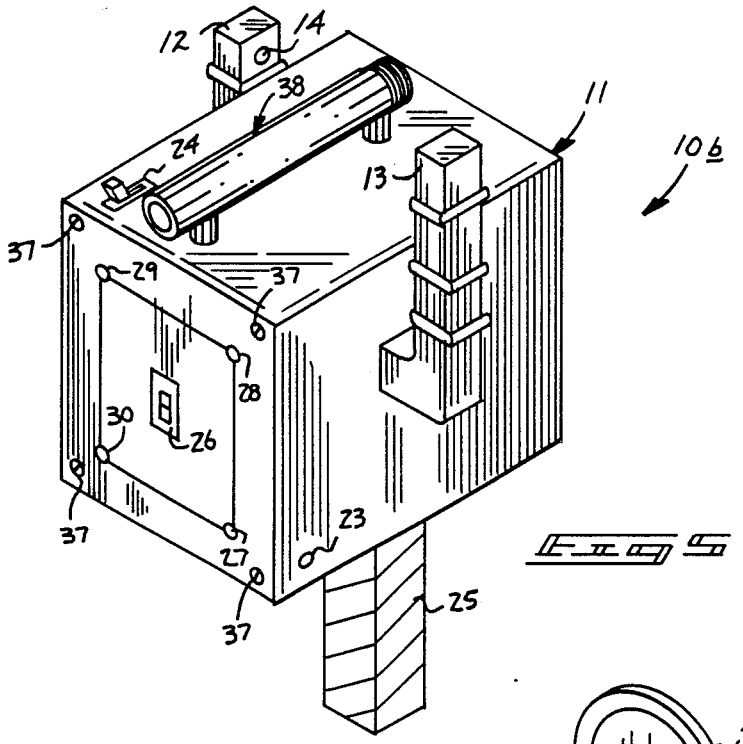
FIG. 5 is an isometric illustration of a further modified utilization of the instant invention.
Figure 6:
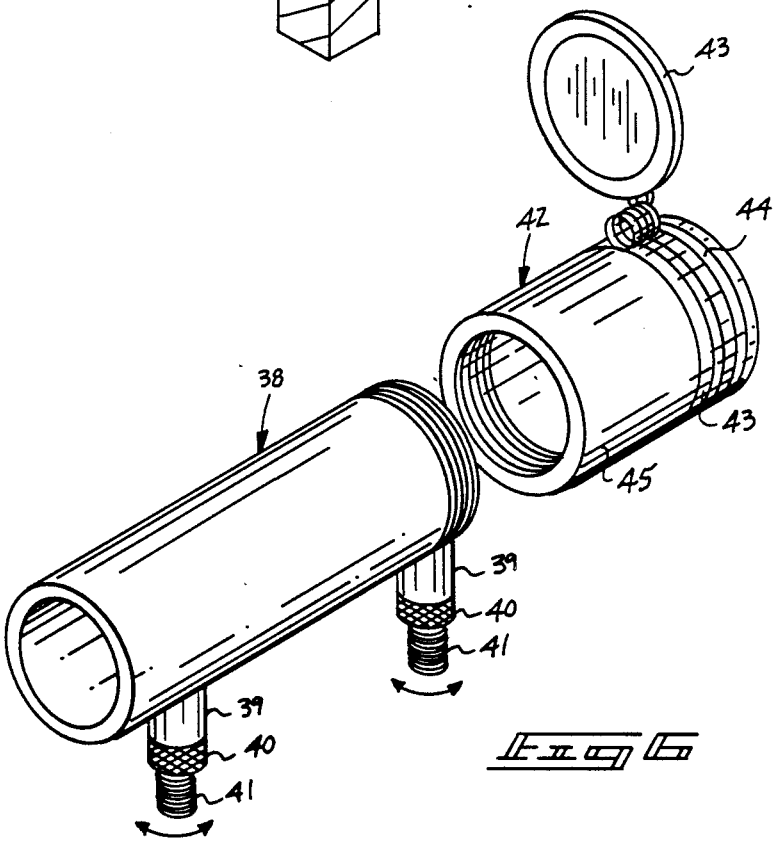
FIG. 6 is an isometric illustration of a modified spotting scope utilized by the instant invention.
Figure 7:
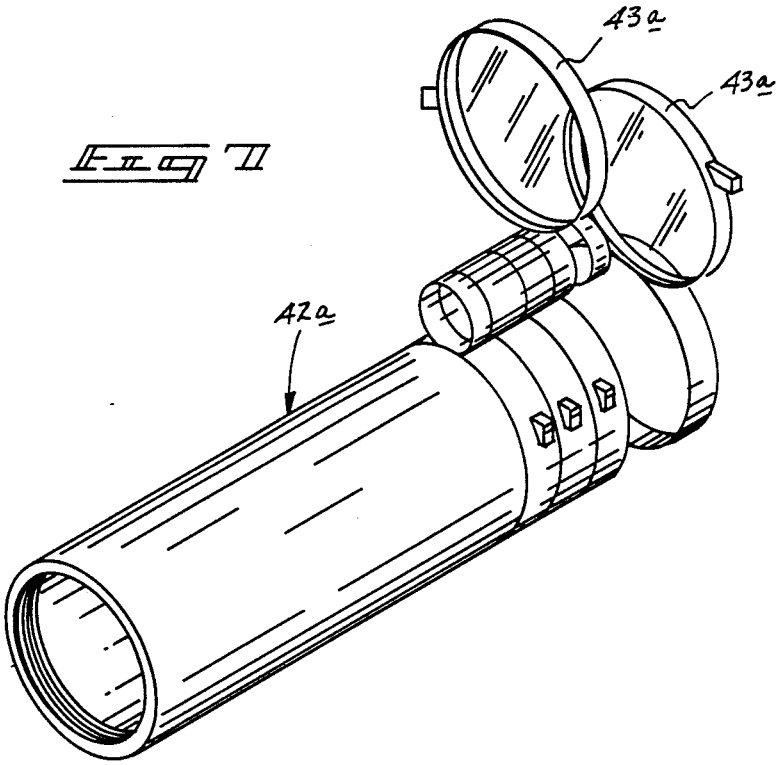
FIG. 7 is an isometric illustration of a further modification of the spotting scope of the instant invention.

FIG. 5 illustrates a further modified device 10*b* utilizing the organizations, as illustrated and discussed above, as well as the utilization of a spotting scope 38 removable from a top surface of the cabinet 11. The spotting scope 8 includes a spaced pair of support bosses 39 directed orthogonally relative to an axis defined by the scope 38. The bosses include knurled rotatable cylinders 40 formed with threaded shanks 41 received within appropriate threaded bores formed within the top surface of the cabinet 11 to enable a child to visually peer through the scope 38 in the search of various "ghosts". The scope 88 is utilized with an optical filter 42. The optical filter 42 is formed with an internally threaded barrel 45 threaded internally at its forward end cooperative with external threads formed about a rear end surface of the scope 38. The optical filter 42 utilizes a cylindrical flip-up lens 43 of a single coloration, wherein a child may fancifully filter various harmful rays of undesirable ghost emissions. FIG. 7 illustrates a further modified filter 42*a* utilizing a series of cylindrical flip-up lenses 43 formed with handles mounted to the cylindrical side surfaces of the various filters 43*a*, wherein the filters 40*a* are of various multi-colors that are utilized individually or in concert to provide various visual effects in the peering through the filter and scope organization when secured together to the top of the cabinet 11.

Figure 8:
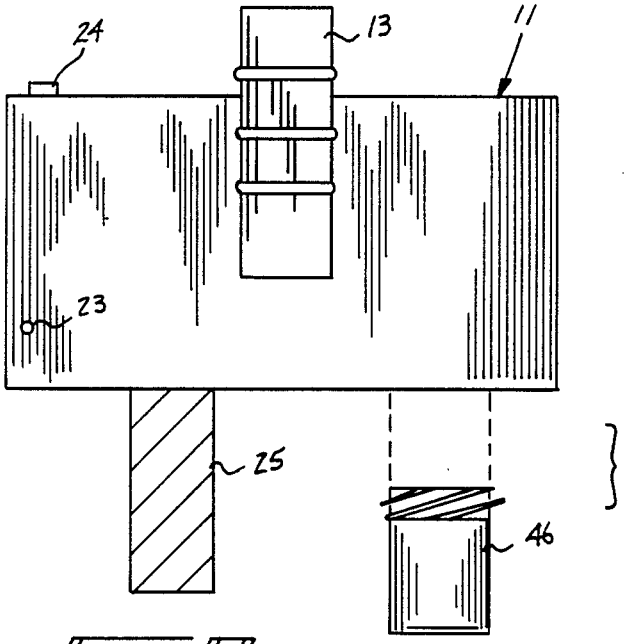
FIG. 8 is an orthographic side view taken in elevation illustrating the use of a cylindrical canister utilized by the instant invention to simulate a repository for captured ghosts.

FIG. 8 illustrates the use of a cylindrical ghost trap 46 formed with an externally threaded upper end that is threadedly received within a lower wall of the cabinet 11 to capture "ghosts" encountered in the use of the device by a child in a fanciful hunt of such imaginative creatures.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toy device simulating detection and capture of fanciful creatures, wherein the device comprises in combination, an enclosed cabinet member including a removable forward wall, a rear wall, a top wall, a bottom wall, a left first wall, and right second wall, wherein the walls define an enclosed parallelepiped configuration, and a first arm mounted to the first wall arranged parallel thereto, and a second arm mounted parallel to the second wall arranged parallel thereto, and the first arm and second arranged parallel relative to one another, and a first series of LED lights mounted on the first arm, and a second series of LED lights mounted on the second arm, the first and second series of lights mounted in confronting relationship relative to one another, and a third series of LED lights mounted on the forward wall, and a handle extending downwardly from the bottom wall, and a switch means for selectively actuating the LED lights, said lights are actuated in sequence relative to one another.

2. A toy device as set forth in claim 1 wherein a numerical LED counter display is mounted medially of the forward wall and medially of the third series of lights.

3. A toy device as set forth in claim 2 including a socket mounted to the rear wall, and a conical member including a threaded shank receivable within the socket, the conical member including translucent panels of various colorations formed about a conical surface defined by the conical member.

4. A toy device as set forth in claim 3 wherein the conical member includes a plurality of contacts cooperative with the socket to illuminate the conical member.

5. A toy device as set forth in claim 4 further including a cylindrical scope member, the cylindrical scope member includes a first and second spaced boss, wherein the first and second spaced bosses are arranged orthogonally relative to an axis defined by the scope member, the scope member further includes an externally threaded rear surface, and a cylindrical filter member, wherein the cylindrical filter member includes a cylindrical body formed with internal threads, the internal threads cooperative with the externally threaded rear surface of the cylindrical scope.

6. A toy device as set forth in claim 5 wherein the cylindrical filter member includes a slot, the slot mounted rearwardly of the filter member, and a series of aligned flip-up cylindrical panels, each cylindrical panel selectively received within said slot for providing varying multi-colored visual effect in visual observation through the filter and the scope.

7. A toy device as set forth in claim 6 further including a cup member, the cup member including an externally threaded cylindrical upper end receivable within the bottom wall of the cabinet member.

* * * * *